US007625265B2

(12) United States Patent
Woods et al.

(10) Patent No.: US 7,625,265 B2
(45) Date of Patent: Dec. 1, 2009

(54) HOOD PLATES FOR HANDHELD GRINDING TOOLS

(75) Inventors: Dennis David Woods, Escondido, CA (US); Dennis Clifford Woods, Murrieta, CA (US); Mark Tretter, Escondido, CA (US)

(73) Assignee: I.T., Inc., Temecula, CA (US)

( * ) Notice: Subject to any disclaimer, the term of this patent is extended or adjusted under 35 U.S.C. 154(b) by 176 days.

(21) Appl. No.: 11/623,047

(22) Filed: Jan. 12, 2007

(65) Prior Publication Data

US 2008/0171501 A1 Jul. 17, 2008

(51) Int. Cl.
*B24B 55/04* (2006.01)

(52) U.S. Cl. ..... 451/451; 451/359; 451/456

(58) Field of Classification Search ..... 451/344, 451/353, 357, 359, 451, 454, 455, 456
See application file for complete search history.

(56) References Cited

U.S. PATENT DOCUMENTS 5,125,190 A * 6/1992 Buser et al. ..... 451/456
5,170,588 A 12/1992 Schaal et al.
5,545,082 A 8/1996 Courson et al.
5,609,516 A * 3/1997 Courson et al. ..... 451/456
6,464,573 B1 * 10/2002 Keller ..... 451/451
7,063,606 B2 * 6/2006 Stierle et al. ..... 451/359
7,311,589 B2 * 12/2007 Wiker ..... 451/451
2005/0037701 A1 * 2/2005 Steimel et al. ..... 451/359
2005/0215186 A1 * 9/2005 Stierle et al. ..... 451/359
2007/0178815 A1 * 8/2007 Buser ..... 451/451

FOREIGN PATENT DOCUMENTS

DE 200 16 263 U1 11/2001
EP 1 321 230 6/2003

OTHER PUBLICATIONS

International Search Report and Written Opinion mailed May 14, 2008 in PCT/US2008/050002.

* cited by examiner

*Primary Examiner*—Eileen P. Morgan
(74) *Attorney, Agent, or Firm*—Baumgartner Patent Law

(57) ABSTRACT

Hood plates for use with hood covers designed for handheld power tools including angle grinders are disclosed herein. More specifically, the hood plates disclosed herein include means for easily attaching to a wide variety of available angle grinders and are easily configured to work with a soft hood cover to allow both horizontal and vertical movement of the grinding attachment within the hood cover.

7 Claims, 3 Drawing Sheets

HOOD PLATES FOR HANDHELD GRINDING TOOLS

FIELD OF THE INVENTION

The present invention generally relates to a hood plates for use with hood covers designed for handheld power tools, such as angle grinders and sanders.

BACKGROUND

The use of power tools such as angle grinders and power sanders generates significant dust as the working surface is smoothed down. Limiting the amount of dust dispersed to the surrounding area is also highly desirable because the inhalation of dust by a user is at best irritable, and at worst a significant health risk. The resulting dust can also unnecessarily contaminate the surrounding walls of the work site and create fire hazards.

Hood covers have been developed to help prevent dust dispersion. In general, hood covers are attached to suitable handheld power tools, and cover the grinding attachment, such as grinding pads, discs, or sand paper, and a defined section of a working surface to be smoothed (e.g., wood, concrete, metal, plastic, fiberglass). Typically, hood covers are in working operation with a vacuum hose or attachment that can suck the dust away from the working area. Most hood covers are made of a hard material, such as metal. While a hard cover may help in protecting the user from the powerful grinding attachment, it does not allow for vertical or horizontal movement of the grinding attachment within the hood cover. Additionally, because different power tools have varied dimensions, it can be very difficult to attach a particular hood cover to different sized tools.

There have been attempts to solve this problem. For example, the hood shield described in U.S. Pat. No. 5,125,190 to Buser et al., includes flexible means for vertical movement, and relies on a hose clamp to connect it to the grinder (see col. 4, lines 30-33). This patent is hereby incorporated by reference herein in its entirety. Unfortunately, the design in Buser et al. does not allow for horizontal movement of the grinder within the shield and makes it burdensome for a user because they must tighten and loosen the clamp each time the shield is attached and removed respectively.

Accordingly, there is a need in the art to provide for a quick release connecting hood plate that allows hood covers to connect to most available suitable power tools. Thus, one object of the invention is to provide new and improved hood plates for easily connecting a suitable hood cover to most, if not all, available handheld grinders. An additional object of the invention is to provide hood plates that can work in conjunction with a pliable hood cover to allow for horizontal and vertical movement of the grinding attachment within the hood.

SUMMARY OF THE INVENTION

According to certain embodiments, the teachings herein disclose hood plates for use with a handheld grinder or power sander. In still further aspects, the hood plates described herein can be attached to and used with most manufactured handheld grinders. The following summary is directed to non-exclusive preferred embodiments.

According to preferred embodiments, the teachings herein provide hood plates for use with a hood cover and a handheld grinder having a collar with a groove, wherein said plates have an outer perimeter, a planar topside and underside, and an inner periphery connected to a plurality of flaps individually having an inner face defining a sectionalized perimeter of an aperture configured to fit around said collar, and wherein said inner face includes means for releasably attaching onto the groove of said collar. In further embodiments, the hood plates provided herein include means for removing dust generated from the grinder and are configured to be in operable connection with a vacuum. According to more specific embodiments, said hood plates provided herein include means for attaching to said hood cover. In even more specific embodiments, said means for attaching onto the groove of said collar consist of a single flange on said inner face of the plurality of flaps.

According to further embodiments, the teachings herein provide hood plate assemblies for attachment to a handheld grinder having a collar with a groove and including a hood cover, having a soft top surface having a main aperture and connected to a lower skirt configured to surround a grinder attachment; a hood plate having means for attaching to the soft top surface of said hood cover, an outer perimeter, a planar topside and underside, and an inner periphery connected to a plurality of flaps individually comprising an inner face defining a sectionalized perimeter of an aperture configured to fit over said collar, wherein said inner face includes means for releasably attaching the hood plate to the collar groove of said handheld grinder.

Preferred hood plate assemblies include a hood plate having means for removing dust generated from the grinder and configured to be in operable connection with a vacuum. Other preferred hood plate assemblies include a hood cover having a second aperture configured to allow passage of said means for removing dust. Preferred means for releasably attaching onto the groove of said collar consist of a single flange on said inner face of the plurality of flaps. In advantageous aspects, said skirt is attached to a flexible bottom ring.

In still further embodiments, the teachings herein provide detachable hood plates for use with a hood cover and a handheld grinder having a collar with a groove including an outer perimeter, a planar topside and underside, and an inner periphery connected to a plurality of flaps defining an aperture configured to fit around said collar and including means for releasably attaching onto the groove of said collar. Preferred hood plates include means for removing dust generated from the grinder and are configured to be in operable connection with a vacuum. According to other embodiments, the hood plates provided herein include means for attaching to said hood cover. In other aspects, preferred means for attaching onto the groove of said collar can include a single flange on said inner face of the plurality of flaps.

BRIEF DESCRIPTION OF THE DRAWINGS

It will be appreciated that the drawings are not necessarily to scale, with emphasis instead being placed on illustrating the various aspects and features of embodiments of the invention, in which.

DETAILED DESCRIPTION OF THE ILLUSTRATED EMBODIMENTS

Embodiments of the present invention are described below. It is, however, expressly noted that the present invention is not limited to these embodiments, but rather the intention is that modifications that are apparent to the person skilled in the art and equivalents thereof are also included.

Hood Cover Plates

In preferred embodiments, the teachings herein are directed to new and improved hood plates for use with hood covers designed for handheld power tools, non-exclusively including angle grinders and power sanders. Embodiments of the invention will now be described with reference to the accompanying figures, wherein like numerals refer to like elements throughout. The terminology used in the description presented herein is not intended to be interpreted in any limited or restrictive manner simply because it is being utilized in conjunction with a detailed description of certain specific embodiments of the invention.

While the terms "attach" and "connect" are used throughout for ease of describing the hood plates 10 provided herein, in preferred embodiments, the entire hood plate 10 is an integral unit, made from a single mold.

Figure 1:
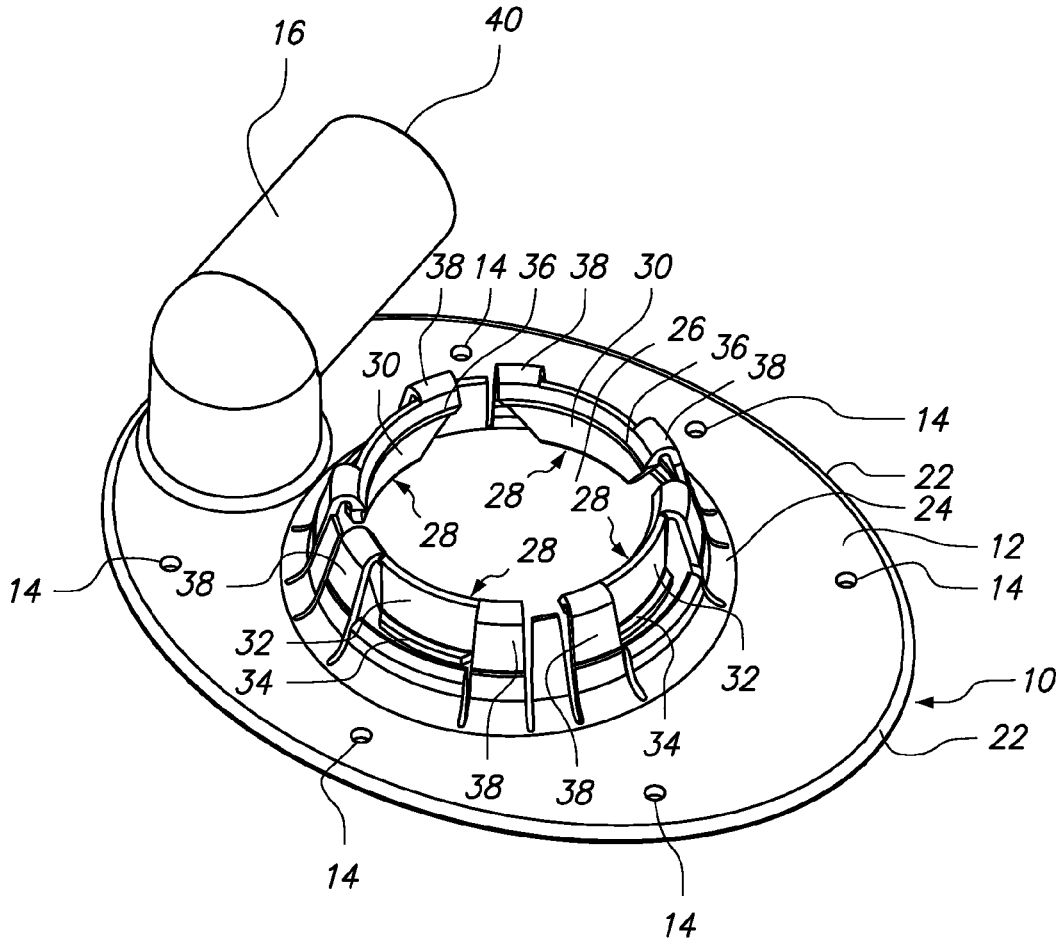
FIG. 1 is a topside view of a preferred hood plate.

FIG. 1 depicts a particular advantageous embodiment of a hood plate 10. According to this preferred embodiment, the hood plate 10 includes an outer periphery 22 surrounding a substantially planar topside 12 and a substantially planar underside 18. Accordingly to preferred aspects, the topside 12 and/or underside 18 include means for removing the dust generated from the power-tool. In preferred embodiments, the means can include an exhaust shaft 16 on the topside 12 that includes an exit opening 40 connected to an entrance opening 20 on the underside 18. In more specific embodiments the exhaust shaft 16 can readily be configured to work with a vacuum hose 200 and/or vacuum attachment, and the like, such that dust is sucked away from the hood plate 10. Other means for removing the dust can include a hole, without a shaft, configured to be attached to a vacuum hose, or vacuum attachment.

Preferred hood plates 10 provided herein are made of a rigid material while maintaining some flexibility. According to more specific embodiments, preferred plates 10 are made of plastic, non-exclusively including, high-grade, molded plastic. In further embodiments, the plates 10 described herein include support ribs 44, including ribs 44 that traverse the plates between the inner periphery 24 and the outer periphery 22, for example. Support ribs 44 can be made of any suitable material including metal, fiberglass, and plastic. Preferred ribs can be located on the topside 12, underside 18, or within the hood plates 10

The topside 12 and underside 18 of the plate 10 preferably surround an inner periphery 24. In preferred embodiments, the outer periphery 22, the topside 12, and underside 18 are concentric with the inner periphery 24. The inner periphery 24 preferably defines a substantially circular area, but other geometric shapes non-exclusively including square, rectangular, oval, for example are also contemplated herein.

In further preferred embodiments, the inner periphery 24 includes a plurality of extensions 38 that are attached to 1 or more flaps 28. In more specific embodiments, extensions 38 can rise vertically and outward from the inner periphery 24 and then curve to attach to a flap 28 that hangs downward and inward towards the inner periphery 24. In preferred embodiments two extensions 38 are attached to the left and right side of a single flap 28. It is readily contemplated that a single extension can be configured to support a single flap, or that 3, 4, or more extensions support 1 or more flaps (e.g., 2, 3, and 4). Preferred flaps have some flexibility in being able to move towards and away from the inner periphery 24.

Figure 2:
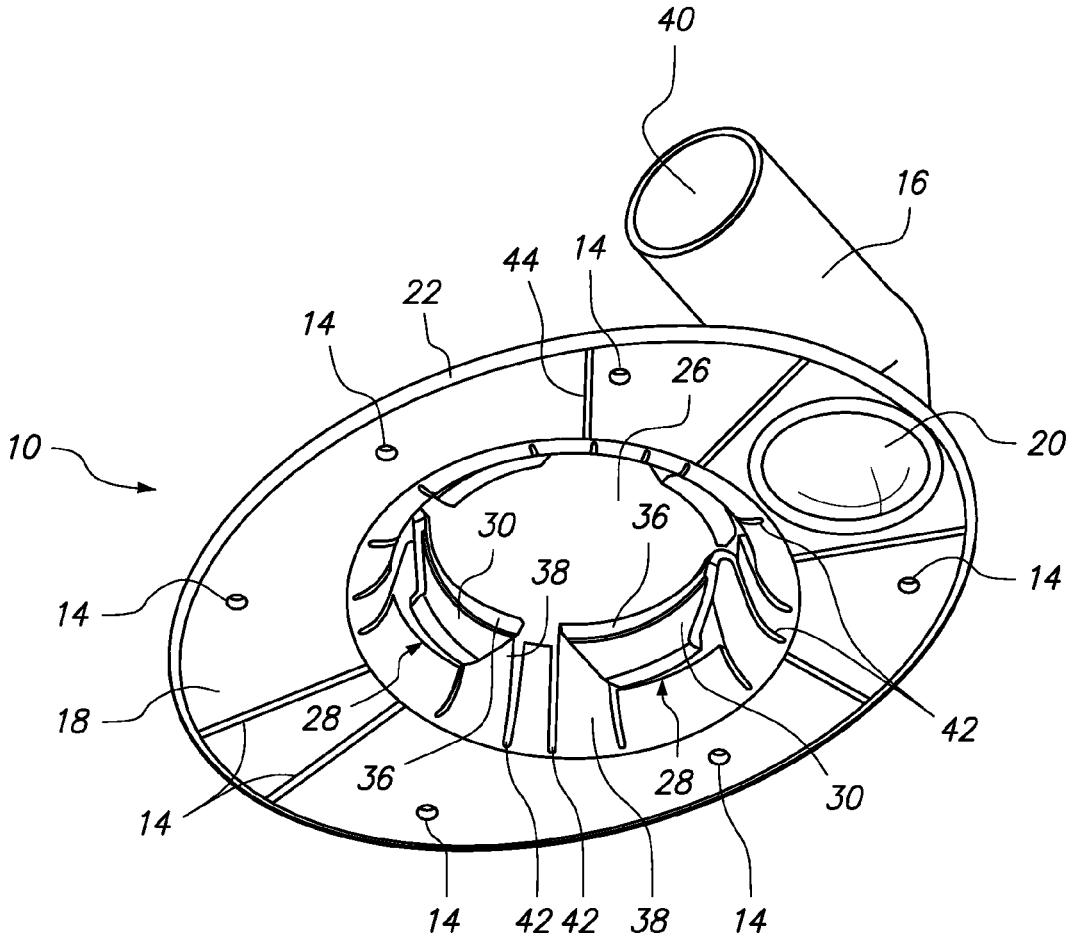
FIG. 2 is an underside view of a preferred hood plate.

According to certain embodiments, the extensions 38 can be separated from each other on the inner periphery 24 or placed together. In preferred embodiments, the extensions 38 can be separated from each other by slots 42 around the inner periphery 24. In other advantageous embodiments, and as depicted in FIGS. 1 and 2, the extensions 38 are separated from each other by a two slots 42 and a separating piece connected to the inner periphery 24. Slots 42 separating the extensions 38 are advantageous in that they give the hood plate 10 more flexibility for attachment to the power tool 300. More specifically, increased flexibility allows a user to more easily snap the hood plate 10 on to different sized power tools 300. Furthermore, as many angle grinders and handheld power tools are very powerful, plates 10 having some flexibility can be more resistant to warping or snapping.

According to preferred embodiments, the flaps include both an inward facing side 30 and an outward facing side 32. According to more preferred embodiments, a plurality of inner facing sides 30 defines a sectionalized perimeter of an aperture 26. The sectionalized aperture 26 is preferably circular in shape and has an inner diameter of approximately 2¾ inches. Other preferred diameters include approximately between 2 and 4 inches (e.g., 2½, 3, 3½ inches). In other non-exclusive advantageous embodiments, the inner sides 30 of the flap 28 are preferably slightly concave. In still further non-limiting embodiments, the flaps 28 are in the shape of an inverted trapezoid.

It is preferred that the sectionalized aperture 26 is configured for attachment to a handheld power tool 300. According to more specific embodiments, the inward faces 30 of the flaps 28 include means for connecting to a handheld power tool 300, and more preferably to a circular groove 310 on a handheld power tool. Typically, the circular metal groove is located on the collar 320 of a power grinder, above a rotating spindle. In more specific embodiments, the means for connecting to the handheld power tool 300 can include a flange 36 that is configured to attach around a collar groove 310 of a handheld power tool 300. The flanges 36 can be attached to any suitable part of an inward face 30, and preferably are located at the top edge of the inner face 30.

In preferred embodiments, the plates non-exclusively include four flaps 28 each having a single flange 36 horizontally traversing the inward face 30. Utilizing a plurality of flanges on a single inner face 30 is also expressly contemplated for use with the teachings herein, according to other embodiments. While various dimensions are contemplated herein, preferred flanges 36 protrude from the inner face 30 toward the aperture 26 approximately 1/16 of an inch or less (e.g., 1/32 inch, 3/32 inch). It is also preferred that the flange 36 is slightly concave, like the inward face 30, such that it conforms to an arc in the collar groove 310. In preferred embodiments, the hood plates 10 described herein can non-exclusively attach to grinders having diameters of approximately between 2¼-2¾ inches. (e.g., 2½ inches, 2⅝ inches), or even 3 inches.

The flexibility in the flaps 28 can advantageously allow the sectionalized aperture 26 to expand when fitting the plate 10 over the thicker part, or collar 320, of the power tool below the groove 310, before the flanges 36 snap into place along the collar groove 310. Additionally, a user can remove the plate 10 from the power tool by first pulling the plate 10 laterally, thereby flexing the flaps 28 toward the inner periphery 24 and expanding the aperture 26. A user can then pull the plate 10 downward, thereby removing the remaining flanges 36 from the collar groove 310.

In further embodiments, it is preferred that the hood plates 10 provided herein include means for adjusting the size of the aperture's 26 perimeter. Suitable means non-exclusively include, various types of clamps, movable or flexible parts, or a combination thereof, and the like, for example. Means for adjusting the size of the aperture's 26 perimeter can be located on any suitable part of the hood plate 10, preferably around the outward face 32 of the flap 28.

In more preferred embodiments, the outward face 32 includes a lip 34 that protrudes away from the outward face 32 and towards the inner periphery 24, that is configured to support a clamp 46 for adjusting the size of the aperture's 26 perimeter. While preferably not contacting the inner periphery in its natural state, the flap 28 can have the flexibility, such that the lip 34 can easily be pushed into the inner periphery 24. Preferred lips 34 protrude toward the inner periphery 24 approximately 1/16 of an inch or more (e.g., 1/8 inch, 3/16 inch). While the number and location of the lips 34 can vary to any suitable spot on the hood plate 10, preferred non-exclusive embodiments include hood plates 10 having four flaps 28, each having with a single horizontally traversing lip at the bottom edge of the outer face 32.

In more preferred embodiments the lips 34 can support a hose clamp 46 that is wrapped around the outward faces 32 of the flaps 28. Hose clamps 46 are readily available in the art and any suitable one can be used with the teachings herein. Preferred hose clamps 46 include those made of one or more of the following materials: metal, rubber, nylon, and/or plastic. In advantageous embodiments, the clamps are flexible enough to wrap around the outward faces 32 of the flaps 28 and surround the sectionalized aperture 26. According to other embodiments, clamps that are semi-circular, or otherwise do not encircle the aperture 26, are also expressly contemplated herein. Typically hose clamps 46, like other clamps that can be used with the plates provided herein, include means for tightening and loosening the clamp (e.g., screw, nut and bolt), thereby allowing for contraction and expansion of the aperture's 26 sectionalized perimeter, respectively.

While clamps 46 can be used to adjust the perimeter of the aperture 26 for the hood plates 10 described herein, they are not always used or desired. The hood plates 10 provided herein can be connected to many grinders through use of flanges 36 alone. In addition, for embodiments where clamps 46 are used to contract the perimeter of the aperture 26, the hood plates are still snapped onto the collar groove 310 through the use of flanges 36. In highly advantageous embodiments, the inner flaps 30 are not entirely smooth and have flanges 36. The hood plates 10 herein are not configured such that the only connecting pressure to the grinder 300 is provided by the clamp 46. The teachings herein are highly advantageous over a clamp-only design (as shown in U.S. Pat. No. 5,125,190 to Buser et al.) as it allows a user to snap the flanges 36 off the collar groove 310 to remove the plate 10 (as described above), without having to loosen the clamp 46, for embodiments where clamps 46 are used.

Figure 3:
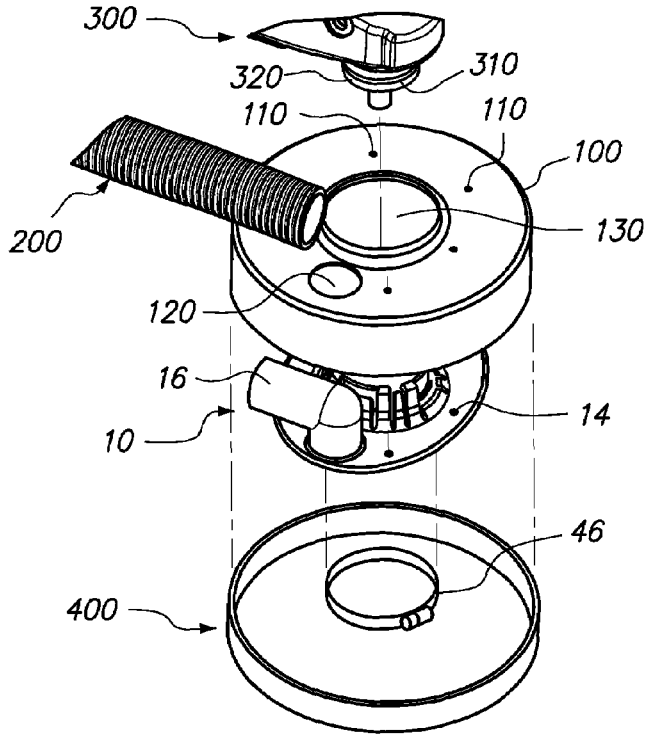
FIG. 3 is an exploded view of a preferred hood plate, hood cover, and grinder assembly.
Figure 4:
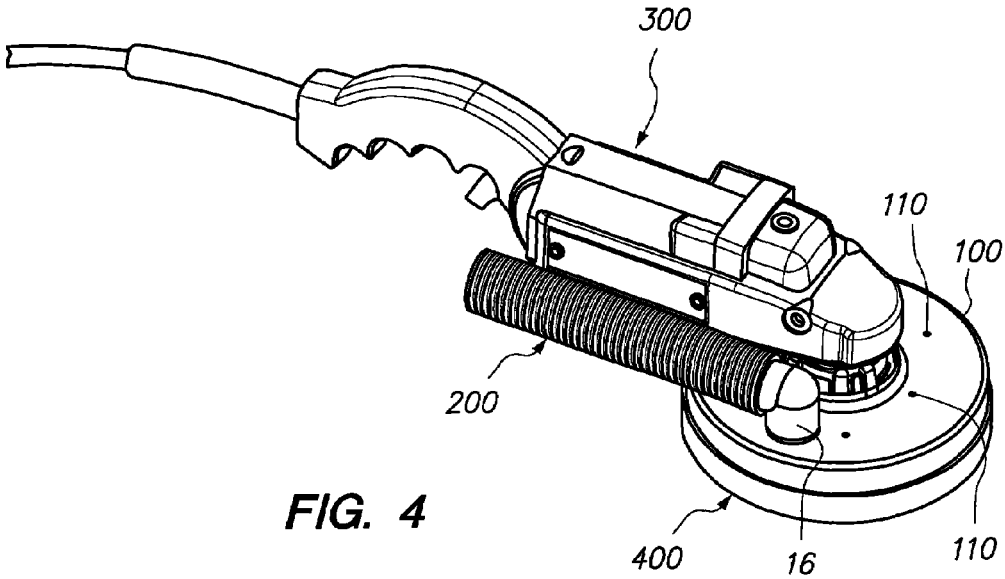
FIG. 4 is a perspective view of an assembled hood plate, hood cover, and grinder.

FIG. 3 and FIG. 4 depict how the hood plates 10 provided herein can be used with a handheld power tool 300 and hood cover 100. In general hood covers 100 are used with handheld power tools 300 such as angle grinders and power sanders to contain and remove the dust generated from a grinding attachment within the hood cover 100 (not shown) and prevent it from being inhaled by the user or contaminating the surrounding environment. Any suitable grinding attachment can work with the hood plates and covers described herein, including sand paper and grinding discs, for example.

Typically, hood covers 100 are in working operation with a vacuum hose 200 or attachment that can suck the dust from the working surface. In more specific embodiments, a hood cover 100 can include a bottom ring 400, that helps maintain the shape of the hood cover 100 and provides a solid surface for moving the power tool 300 along a working surface. In further embodiments, the bottom ring 400 has some flexibility to allow the grinding attachments to smooth surfaces that are close to a wall or other obstruction. More specifically, when the bottom ring 400 comes into contact with a wall or other obstruction, it can bend inward, allowing the grinding attachment within the hood 100 to smooth the working surface near the wall or obstruction. Hood covers 100 can be attached to bottom rings 400 by any suitable means available, non-exclusively including snaps, fasteners, adhesives, ties, male-female connectors, quick release devices, screw, sealing, and hook and loop fasteners, such as those sold under the trademark VELCRO®.

Preferred hood covers 100 to be used with the teachings herein are generally lightweight, and are usually made of leather, nylon or plastic, although other suitable materials are also available. In preferred embodiments the hood cover 100 is made of a pliable material such as leather or nylon to allow for vertical and horizontal movement of the grinding attachment within the hood, as the user smoothes down the working surface. Accordingly, as used herein, the terms "pliable" and "soft" generally relate to materials on the topside of the hood cover that allow for horizontal and vertical movement of the grinding attachment within the hood cover. For example, hood covers having a soft topside and a hard plastic skirt are contemplated herein, as are hood covers made entirely of a soft material such as leather or nylon, for example. In other embodiments, the hood covers described herein can be used with an entirely hard cover (metal, or hard plastic), or a mixture of soft and hard material.

Preferred hood covers include a main hole 130 that allows the top of the hood plate 10 to pass through the hood cover 100 and connect to the grinder 300. Additionally, the rotating spindle of the grinder 300 can pass through the main hole 130 to attach to a grinding attachment (not shown). The main hole 130 can be located at any suitable location on the hood cover 100, but in preferred embodiments is centrally located on the top. The hood cover 100 also preferably includes an exhaust hole 120 to allow an exhaust shaft 16 from the hood plate 10 to connect to a vacuum hose 200 or attachment. According to other embodiments, such as where a hood plate 10 does not include an exhaust shaft 16, a vacuum hose could be inserted directly into the inside of a hood cover 100, for example.

Preferred hood plates provided herein 10 can include means for attaching to a hood cover 100. According to more specific embodiments, the plates described herein include locations 14 around the topside 12 surface where one or more fasteners can be used to attach to the hood cover 100 at corresponding sites 110. Preferred fasteners that can be placed on the sites 14 to attach the plate 10 to the locations 110 on the hood cover 100 non-exclusively include snap fasteners, ties, adhesives, clips, male-female connectors, quick release mechanisms, buckles, and hook and loop fasteners, including those sold under the registered trademark VELCRO®, and the like, for example. While the holes (14 and 110) may be present after manufacturing of the plate 10 or hood cover 100, according to preferred working embodiments, the holes (14 and 110) are not present, but rather they are sites for complementary means for fastening the plate 10 to the hood cover 100.

The invention may be embodied in other specific forms besides and beyond those described herein. The foregoing embodiments are therefore to be considered in all respects illustrative rather than limiting, and the scope of the invention is defined and limited only by the appended claims and their equivalents, rather than by the foregoing description.

The invention claimed is:

1. A hood plate for releasably attaching to a handheld grinder, said grinder having a collar with an annular groove, said hood plate comprising:

a plurality of flaps individually comprising a concave inner face defining a sectionalized perimeter of an aperture configured to fit around said collar, and wherein said inner faces individually comprise a concave flange in the shape of a circular arc that laterally traverses the inner faces and is configured to fit within the annular groove of said collar.

2. The assembly of claim 1, wherein the inner faces include no more than one flange each.

3. The assembly of claim 1, wherein the flange is configured to extend approximately $1/16^{th}$ of an inch away from the inner face.

4. The assembly of claim 1, wherein the flaps further comprise means for adjusting the size of the aperture's perimeter to accommodate various sizes of collars.

5. The assembly of claim 1, wherein the assembly further comprises means for supporting a hose clamp around the outward faces of the flaps.

6. The assembly of claim 1, wherein the flaps are configured to move towards the collar for attachment and away from the collar for releasing.

7. The assembly of claim 6, wherein the flaps are made of flexible plastic.

* * * * *